US012065222B2

(12) United States Patent
Todter

(10) Patent No.: US 12,065,222 B2
(45) Date of Patent: Aug. 20, 2024

(54) METHOD, APPARATUS AND SYSTEM FOR RECOVERING A SAILING VESSEL

(71) Applicant: SubSeaSail LLC, San Diego, CA (US)

(72) Inventor: Chris Todter, San Diego, CA (US)

(73) Assignee: SubSeaSail, Inc., San Diego, CA (US)

( * ) Notice: Subject to any disclaimer, the term of this patent is extended or adjusted under 35 U.S.C. 154(b) by 413 days.

(21) Appl. No.: 17/560,093

(22) Filed: Dec. 22, 2021

(65) Prior Publication Data

US 2022/0194528 A1 Jun. 23, 2022

Related U.S. Application Data

(60) Provisional application No. 63/128,944, filed on Dec. 22, 2020.

(51) Int. Cl.
*B63B 39/02* (2006.01)
*B63B 79/15* (2020.01)
*B63B 79/40* (2020.01)

(52) U.S. Cl.
CPC ..... *B63B 39/02* (2013.01); *B63B 79/15* (2020.01); *B63B 79/40* (2020.01)

(58) Field of Classification Search
CPC ..... B63B 39/00; B63B 39/02; B63B 79/00; B63B 79/15; B63B 79/40
USPC ..... 114/121
See application file for complete search history.

(56) References Cited

U.S. PATENT DOCUMENTS 5,072,682 A 12/1991 Rodriguez Urroz et al.
5,570,651 A 11/1996 Schiff
5,848,574 A 12/1998 Lande
5,947,045 A 9/1999 Pietro
7,255,054 B1 8/2007 DiGregorio
7,568,442 B2 8/2009 Kruppa
8,973,511 B2 * 3/2015 Holemans ..... B63B 35/00 114/39.26
9,003,986 B2 * 4/2015 Jenkins ..... B63B 43/00 114/39.26
10,399,651 B2 * 9/2019 McClure ..... B63B 41/00
10,633,058 B1 4/2020 Rawdon
(Continued)

OTHER PUBLICATIONS

ORMA Ocean Racing Multihull Association, 2004-Class Rules Safety regulations, general publication, Dec. 1, 2003, ORMA, Paris, France.

(Continued)

*Primary Examiner* — Lars A Olson
(74) *Attorney, Agent, or Firm* — Thibault Patent Group

(57) ABSTRACT

A self-righting sailing vessel is described. The self-righting sailing vessel may determine the occurrence of several predetermined events, such as the self-righting sailing vessel capsizing, present or imminent inclement weather, and/or a present or imminent vessel or large marine animal. Upon detection of one of these events, the self-righting sailing vessel causes at least it's hull to become partially or completely submerged beneath the water. The self-righting sailing vessel is configured such that its rig is more buoyant than the rest of the vessel when the vessel is completely submerged beneath the water, causing the vessel to move towards an upright position while underwater. When the vessel is pointing towards an upright position, the vessel may begin ascending until it surfaces and is ready to continue sailing on top of the water.

20 Claims, 10 Drawing Sheets

(56) References Cited

U.S. PATENT DOCUMENTS

| | | | |
|---|---|---|---|
| 10,710,685 | B2 | 7/2020 | Cronwright |
| 10,899,422 | B2 | 1/2021 | Schmidt et al. |
| 10,996,676 | B2 | 5/2021 | Johnson et al. |
| 11,117,642 | B2 | 9/2021 | Hofbauer |
| 2009/0228162 | A1 | 9/2009 | Sanchez |
| 2013/0210297 | A1 | 8/2013 | Maas et al. |
| 2018/0072393 | A1 | 3/2018 | Jenkins et al. |
| 2018/0162502 | A1 | 6/2018 | McClure et al. |
| 2019/0135401 | A1 | 5/2019 | Todter |
| 2020/0262532 | A1 | 8/2020 | Berg et al. |

OTHER PUBLICATIONS

Dhome, Further Development and Performance Evaluation of the Autonomous Sailing Boat, Maribot Vane, Dec. 31, 2017, retrieved from the Internet on Jul. 14, 2022 at https://www.diva-portal.org/smash/record.jsf?dswid=-3182&pid=diva2%3A1198963&c=2&searchType=SIMPLE&language=en&query=autonomous+sailing+boat&af=%5B%5D&aq=%5B%5B%5D%5D&aq2=%5B%5B%5D%5D&aqe=%5B%5D&noOfRows=50&sortOrder=author_sort_asc&sortOrder2=title_sort_asc&onlyFullText=false&sf=all.

* cited by examiner

METHOD, APPARATUS AND SYSTEM FOR RECOVERING A SAILING VESSEL

CROSS REFERENCE TO RELATED APPLICATION

The present application claims the benefit of provisional application No. 63/128,944, filed on Dec. 22, 2020, entitled "Method, Apparatus and System for Submerging and Righting a Capsized Watercraft".

BACKGROUND

Field of Use

The present application relates to the maritime industry. More specifically, the present application relates to sailing vessels.

Description of the Related Art

Autonomous marine vessels are becoming more ubiquitous, as they offer capabilities unmatched by manned vessels, such as the ability to undertake long voyages without the need for onboard personnel, food or water. In some cases, even fuel is not required, in the case of unmanned sailing vessels, such as mono hull sailboats and multi-hull vessels, such a catamarans and trimarans. Autonomous sailing vessels may be particularly useful in commercial or military applications, as they are quiet and can operate for long time periods without human intervention.

One problem with autonomous sailing vessels, especially multihull vessels, is that they have a potential to capsize in certain adverse weather conditions. Once capsized, they generally cannot right themselves without human intervention. Multihull vessels, when upright, have a center of gravity (CG) located vertically above a center of buoyancy (CB), which places them in an unstable equilibrium position, i.e., when rolled, a multi-hull vessel generates a righting moment that combats the rolling moment and attempts to return the vessel to the upright position. If a multi-hull vessel is rolled far enough by the wind acting on its sail (or "wing", collectively a "rig"), the CG will then naturally position itself lower than the CB, which places the vessel in a stable equilibrium position, i.e., being blown over to the horizontal, from which it will not recover without intervention.

Multihull vessels are attractive for autonomous use since they have good load-carrying potential and good speed potential, are lighter than a ballasted monohull, and require little, if any, fuel. However, their use has heretofore been limited because of their inability to autonomously right themselves after capsizing. Therefore, it would be desirable to configure such vessels to autonomously self-right themselves so that they can be used in unmanned missions.

SUMMARY

The embodiments described herein relate to a self-righting sailing vessel. In one embodiment, a self-righting sailing vessel comprises a hull, a rig coupled to the hull, the rig comprising a mast and a sail, an outrigger coupled to the hull, an attitude sensor, and a processing unit comprising a processor coupled to a memory, the memory comprising processor-executable instructions that, when executed by the processor, causes the processing unit to determine, by the processor, an occurrence of a predetermined event, in response to determining the occurrence, causing, by the processor, the hull to completely submerge beneath water, determine, by the processor via the attitude sensor, that an attitude of the mast is less than a predetermined angle, and in response to determining that the attitude of the mast is less than the predetermined angle, cause, by the processor, the hull to begin resurfacing.

In another embodiment, a method for self-righting a sailing vessel is described, the method comprising determining, by a processor of the sailing vessel, an occurrence of a predetermined event, in response to determining the occurrence, causing, by the processor, a hull of the sailing vessel to completely submerge beneath water, determining, by the processor, that an attitude of the mast is less than a predetermined angle, and in response to determining that the attitude of the mast is less than the predetermined angle, causing, by the processor, the hull to begin resurfacing.

BRIEF DESCRIPTION OF THE DRAWINGS

The features, advantages, and objects of the embodiments of the present invention will become more apparent from the detailed description as set forth below, when taken in conjunction with the drawings in which like referenced characters identify correspondingly throughout, and wherein.

DETAILED DESCRIPTION

The present application describes various embodiments of a self-righting sailing vessel that automatically recovers itself after capsizing and, in some embodiments, capable of autonomously, or via remote control, submerging itself to avoid potential threats such as bad weather or hostile enemy activity, or to launch and/or recover one or more smaller vessels, deploy one or more payloads, observe and record measurements of a surrounding aquatic environment, or some other activity. "Recover" or "recovery" as used herein means that a sailing vessel re-establishes itself in an upright position on the water so that it can continue sailing. The concepts described herein are generally applicable to unmanned monohull vessels, such as traditional sail boats, or multihull vessels, such as catamarans or trimarans, but could also be applied to virtually any type of marine vessel, whether sail-propelled or not and whether manned or not.

Figure 1:
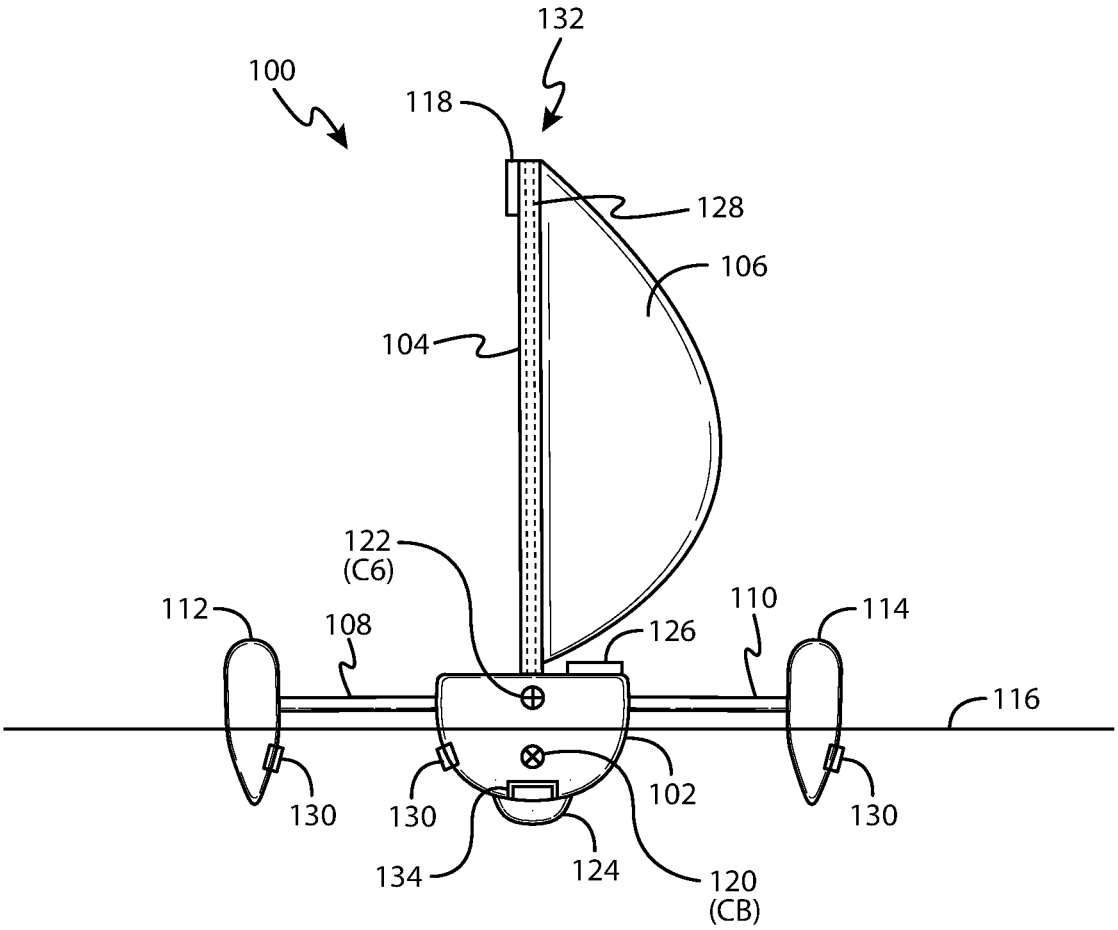
FIG. 1 is an aft view of one embodiment of a self-righting sailing vessel sailing in an upright position on the water.

FIG. 1 is an aft view of one embodiment of a self-righting sailing vessel 100 sailing in an upright position on water 116, comprising hull 102, mast 104, sail 106, port strut 108, starboard strut 110, port outrigger 112, and starboard outrigger 114. It should be understood that sailing vessel 100 is merely representative of a number of different sailing vessel configurations, and that the inventive concepts described herein are equally applicable to those other configurations. For example, other sailing vessels may utilize two or more sails, be larger or smaller than sailing vessel 100 as shown, comprise a single hull, additional hulls, additional outriggers, etc.

Sailing vessel 100, in one embodiment, is 30 feet long, 10 feet wide, comprising a displacement of 10,000 pounds. However, the inventive concepts described herein could be applied to other sailing vessels that are much smaller, or much larger, than these dimensions.

Sail 106 comprises one or more traditional soft sails, rigid wings, semi-rigid wings, inflatable wings, etc. In some embodiments, sail 106 is constructed from a lightweight, substantially rigid material such as molded fiber composite material or aluminum alloy. In cross-section, sail 106 (sometimes referred to as a "wing" or "wingsail") is preferably configured as an airfoil that generates propulsive force (analogous to upward "lift" of an aircraft wing, but in a generally horizontal direction) regardless of whether an angle of attack is to the right or left of the wind, suitable foil configurations being known to those skilled in the relevant art. In another embodiment, the sail is constructed from a lightweight, flexible material such as cloth, nylon, Dacron®, Spectra®, Dyneema®, mylar, carbon fiber, etc. In these embodiments, sail 106 may be partially or fully inflated by the flow and pressure of incident wind, i.e., when sail 106 is formed similar to a ram air hang glider or kite wing.

Mast 104 extends generally perpendicularly from hull 102 and sail 106 is coupled to mast 104 as known in the art. In one embodiment, a channel 128 is formed longitudinally, inside mast 104, with one end exposed to the ambient air, typically at or near a distal end 132 of mast 104, and the other end of channel 128, near hull 102, coupled to a pump 134 via appropriate tubing or the like (not shown). If sailing vessel 100 capsizes, hull 102 may be made to submerge in water 116 by filling one or both outriggers, hull 102, and/or a ballast tank 124 with water (as described later herein), so that sailing vessel 100 achieves a more upright position in the water, and then pump 134 may pump ambient air from distal end 132 of mast 104 through channel 128 and into one or both of the outriggers, hull 102, and/or ballast tank 124, causing sailing vessel 102 to surface in an upright position and capable of continuing to sail on the water.

Mast 104 and sail 106 may be collectively referred to herein as a "rig". A buoyancy of the rig with respect to a buoyance of hull 102 and any outriggers, as well as the overall buoyancy of sailing vessel 100 with respect to a center of gravity of sailing vessel 100, are important design considerations in order to achieve self-righting capabilities when sailing vessel 100 is completely, or partially, submerged under the water. Generally, the rig and the rest of sailing vessel 100 is designed such that the center of buoyancy of sailing vessel 100 is higher than the center of gravity of sailing vessel 100 when sailing vessel 100 is partially, or completely, submerged.

In some embodiments, buoyancy of the rig is increased over prior art designs by selection of materials that form mast 104. For example, rather than wood or steel, mast 104 could be manufactured using a lightweight, strong polymer, such as ultra-high molecular weight polyethylene fibers (UHMWPE), any polyacrylonitrile-based material, or any other strong, lightweight material. Mast 104 may, additionally, be formed with an increased diameter versus prior art masts for similarly-sized vessels, which adds volume and, therefore, buoyancy to mast 104.

In other embodiments, buoyancy of the rig is increased over prior art designs by using a lightweight rigid, semirigid, or inflatable, wingsail for sail 106. The design of such a wingsail, such as its size and weight, will depend on several factors, such as the weight of hull 102, the weight of the outriggers, the weight of the rig, the displacement of the rig, the displacement of the outriggers and hull 102, and an expected thrust generated by sail 106. Generally, the size and materials of sail 106 is chosen such that a center of buoyancy (CB) 120 of sailing vessel 100 is located below a center of gravity (CG) 122 of sailing vessel 100 when sailing vessel 100 is sailing normally, as shown in FIG. 1, and when sailing vessel 100 is partially, or completely, submerged underwater, CB 120 is repositioned so that it resides above CG 122. In one embodiment, buoyancy of sail 106 is increased by increasing a length of sail 106 more than the typical length of a sale on a similarly-sized vessel.

In one embodiment, a buoyancy device 118 may be attached to mast 104, shown in FIG. 1 as being attached to an upper portion of mast 104. Buoyancy device 118 is configured to increase the buoyancy of the rig beyond that of prior art rigs, so that sailing vessel 100 will automatically right itself underwater. In prior art sailing vessels, buoyancy of the rig is not a typical design parameter, and if a prior art sailing vessel were to capsize and sink, the vessel will not generally right itself while underwater. While buoyancy device 118 is shown attached to an upper portion of mast 104, and other embodiments it could be attached to mast 104 at other points along mast 104, span the length of mast 104, or encircled mast 104, similar to a doughnut or a cylinder.

In another embodiment, buoyancy device 118 comprises a self-inflating device, such as an inflatable bladder coupled to an inflation mechanism, such as a CO2 cartridge or other source of compressed gas. In one embodiment, this buoyancy device is coupled to processing unit 126 and processing unit 126 causes buoyancy device 118 to inflate its bladder when processing unit 126 determines that either sailing vessel 100 has capsized, or to self-right sailing vessel 100 when sailing vessel 100 is partially, or completely, submerged under the water. In a related embodiment, buoyancy device 118 comprises a depth or pressure sensor that automatically causes the bladder to inflate when buoyancy device 118 reaches a predetermined depth, such as 10 feet or more. Inflating the bladder creates a large buoyancy near distal end 132 of mast 104, thus moving the overall buoyancy of sailing vessel 100 further away, and above, the center of gravity of sailing vessel 100. This causes sailing vessel 100 to tend to rotate towards an upright position while underwater.

Sailing vessel 100 additionally comprises a processing unit 126, in one embodiment, configured to detect the occurrence one or more predetermined events, such as when sailing vessel 100 has capsized, the presence or anticipation of inclement weather, and/or a present or imminent proximate threat, such as the presence or anticipation of another vessel or large marine animal in proximity to sailing vessel 100. In response to detecting one or more of the predetermined events, processing unit 126 is configured to autonomously and purposefully scuttle, or submerge, sailing vessel 100, either partially or completely, typically by controlling one or more electro-mechanical valves 130 located on ballast tank 124, one or both outriggers, and/or hull 102, which allows water and/or compressed gas to enter the ballast tank 124, outrigger(s) and/or hull 102, causing ballast tank 124, the outrigger(s) and/or hull 102 to drastically reduce its buoyancy. The valve(s) 130 may be opened and closed via signals received from processing unit 126, causing the valve(s) to open and close electronically, hydraulically, or by a pressure applied to the valve(s). While shown mounted to a top surface of hull 102, processing unit 126 is typically located inside hull 102 in order to protect processing unit 126 from the elements.

Figure 2:
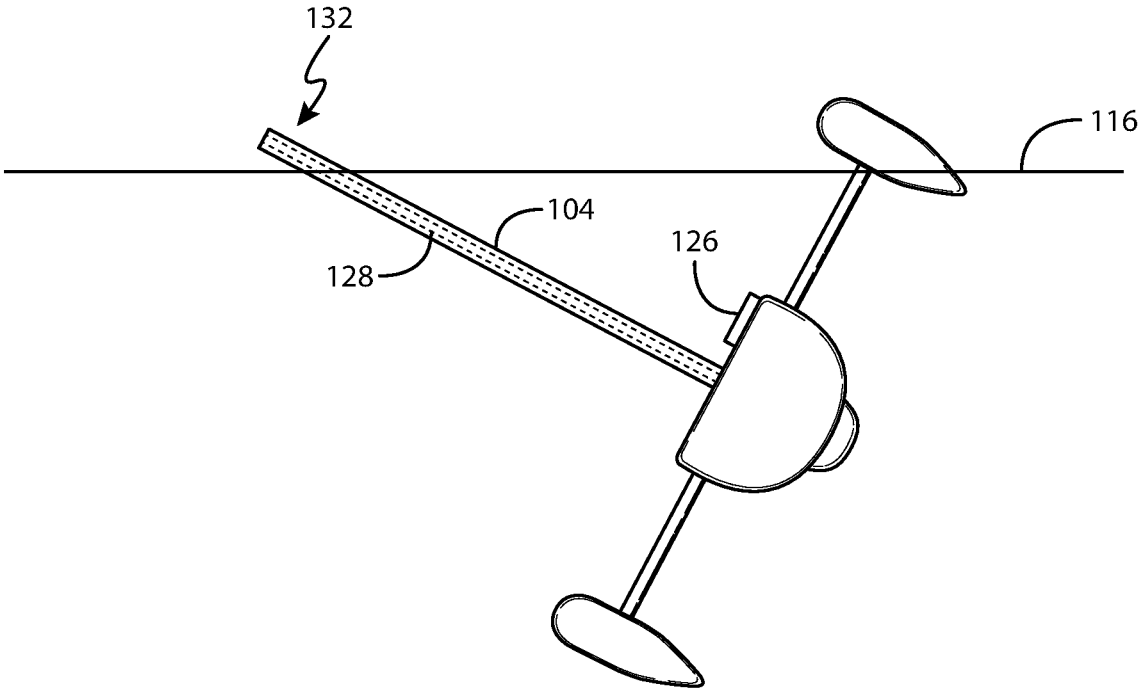
FIG. 2 is an aft view of the self-righting sailing vessel shown in FIG. 1 shown partially submerged under water, with its hull completely submerged and a distal end of its mast remaining above the surface of the water.

In one embodiment, in the case of partial submersion caused either purposely by processing unit 126 or by rough seas and/or the wind (i.e., sailing vessel 100 has capsized), as shown in FIG. 2, hull 102 is completely submerged underwater 116 while at least distal end 132 of mast 104 may remain above the surface of water 116 due to the overall buoyancy of the rig, or due to buoyancy device 118, causing distal end 132 to float. In the partially submerged position shown in FIG. 2, other elements of sailing vessel 100 may protrude from the surface of water 116, such as one of the outriggers, a corresponding strut, and/or portions of sail 106.

Figure 3:
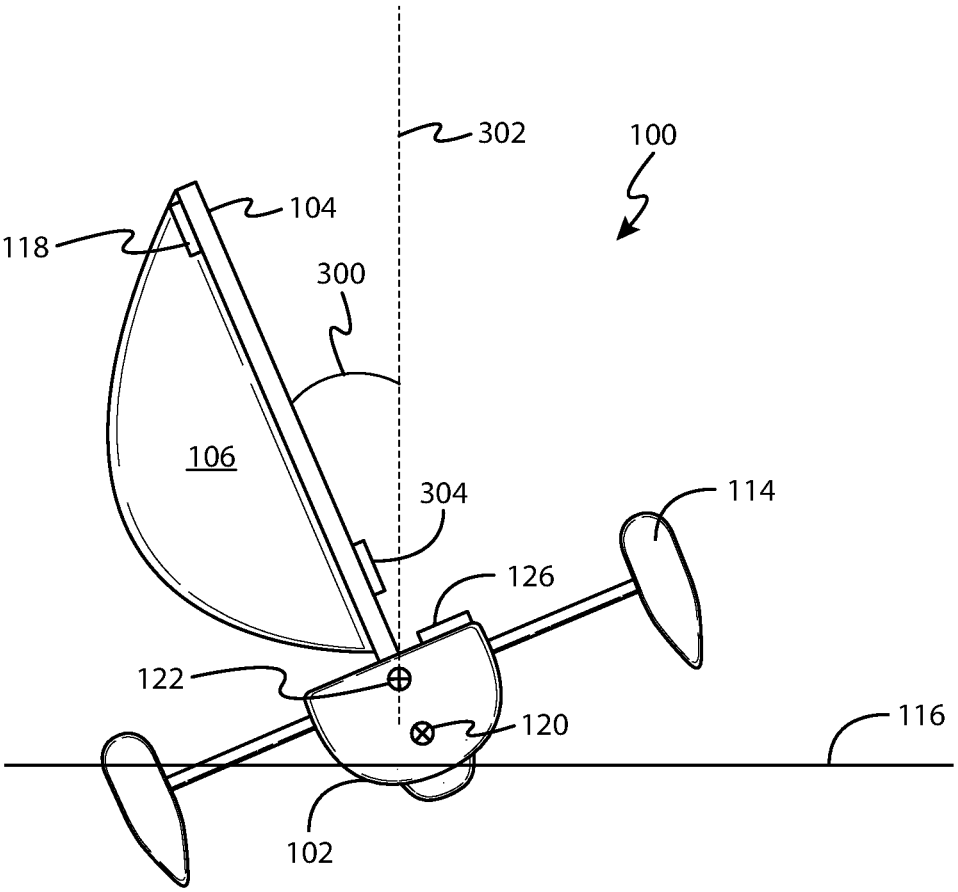
FIG. 3 is an aft view of one embodiment of the self-righting sailing vessel shown in FIGS. 1 and 2, shown rolled counter-clockwise on the water at an angle from an imaginary vertical axis extending through a center of gravity of the self-righting sailing vessel as a wind blows from the starboard.

FIG. 3 is an aft view of one embodiment of sailing vessel 100, shown rolled counter-clockwise at an angle 300 from an imaginary vertical axis 302 extending through CG 122 of sailing vessel 100 as a wind blows from the starboard. Angle 300 may be referred to herein as an "attitude" of sailing vessel 100, typically measured with respect to mast 104 against vertical axis 302. At angle 300 as shown, CG 122 and CB 120 cause a righting moment to act on sailing vessel 100, counteracting an opposing rolling moment caused by the wind. If the wind becomes too strong, it may cause sailing vessel 100 to capsize, laying the rig horizontally on top of water 116.

The attitude of sailing vessel 100, as well as other measurements pertaining to sailing vessel 100, may be determined by an "attitude sensor, such as sensor 304, which may comprise an accelerometer mounted, for example, to mast 104 as shown. In another embodiment, sensor 304 comprises an inertial measurement unit (IMU), which is an electronic device that measures and determines one or more forces, angular rates, and/or orientations of sailing vessel 100 using a combination of accelerometers, gyroscopes, GPS, and/or magnetometers. In other embodiments, the attitude sensor may comprise inclinometer 412 and/or camera(s) 404 (described later herein). In any case, the attitude sensor is electronically coupled to processing unit 126 and may provide raw or processed electronic signals to processing unit 126, indicating at least the attitude of sailing vessel 100 and, in some cases, vessel and/or rig acceleration information (i.e., a magnitude and direction of how the rig is moving over time, indicative how hard sailing vessel 100 is being pitched in the water by the weather, i.e., the wind, waves and current).

Figure 4:
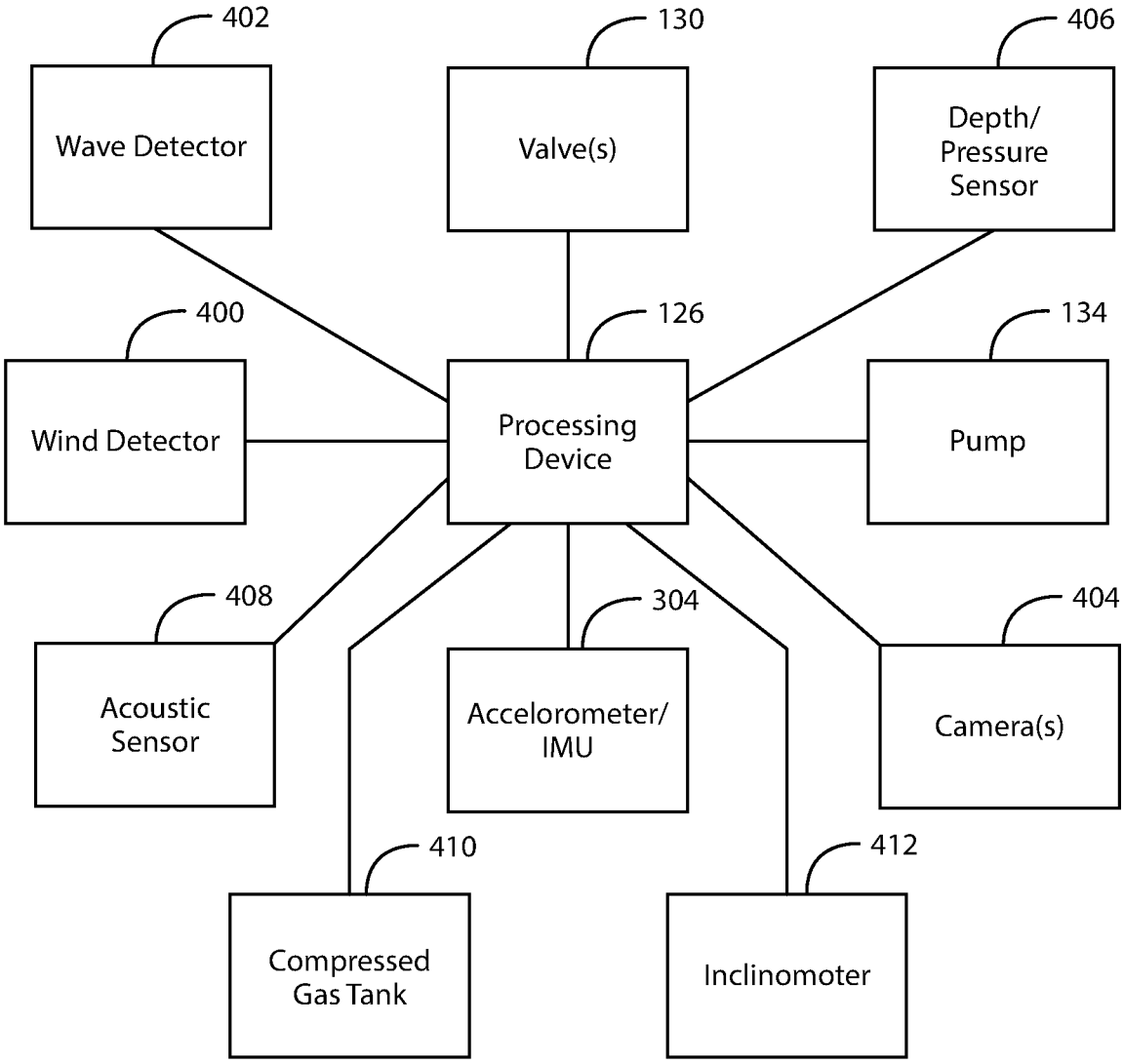
FIG. 4 is a functional block diagram illustrating various components of the self-righting sailing vessel shown in FIGS. 1-3 that interact with a processing unit in order to detect certain conditions of the self-righting sailing vessel and/or environmental conditions that the self-righting sailing vessel is operating, to determine when the self-righting sailing vessel has capsized, autonomously submerge, hold position, determine one or more conditions for resurfacing, and cause the self-righting sailing vessel to surface.

FIG. 4 is a functional block diagram illustrating various components of sailing vessel 100 that interact with processing unit 126 in order to detect certain conditions of sailing vessel 100 and/or environmental characteristics of weather, waves, other vessels, large marine animals, etc., in an area where sailing vessel 100 is operating, for determining that sailing vessel 100 has capsized, detecting a threat, autonomously submerging, holding position, determining one or more conditions for resurfacing, and causing sailing vessel 100 to surface. Shown is processing unit 126 coupled to accelerometer/IMU 304 (discussed previously), pump 134 (discussed previously), one or more electronically-controlled valves 130 (discussed previously), wind detector 400, wave detector 402, one or more cameras 404, depth/pressure sensor 406, acoustic sensor 408, compressed gas tank 410 and inclinometer 412. In some embodiments, not all of the components shown in FIG. 4 are used. For example, accelerometer/IMU 304 may be used to provide wind, wave, attitude, and status (i.e., partially submerged, fully submerged, partially surfaced, fully surfaced, etc.), eliminating the need for wind detector 400, wave detector 402 and camera(s) 404. It should be understood that some or all of the components shown in FIG. 4 could be incorporated within processing unit 126. Wave detector 402, wind detector 400, accelerometer/IMU 304, inclinometer 412 and camera(s) 404 may be referred to herein as "motion detectors".

Processing unit 126 may receive raw or processed signals from accelerometer/IMU and camera(s) 404 to determine when sailing vessel 100 has capsized or submerged. For example, processing unit 126 may receive a signal from accelerometer/IMU 304 indicating an attitude of sailing vessel 100 that exceeds a predetermined angle for a predetermined amount of time, such as an angle from the vertical of 80 degrees for more than 30 seconds, potentially indicating that sailing vessel 100 is lying horizontally on the water's surface. Alternatively, or in addition, signals from camera(s) 404 may be compared to reference images or video stored in processing unit 126 indicative that sailing vessel 100 has capsized.

Processing unit 126 may receive raw or processed signals from wind detector 400, wave detector 402, accelerometer/IMU 304, acoustic sensor 408 and/or camera(s) 404 to determine when inclement weather is present, or approaching, and/or whether a proximate threat is present, or approaching. For example, processing unit 126 may receive signals from wind detector 400 and wave detector 402 and compare the signals to reference signals stored in processing unit 126. If one or both of the signals exceeds one or more thresholds, processing unit 126 may determine that sailing vessel is operating in inclement weather, characterized by high winds and/or high waves. Processing unit 126 may also determine inclement weather using signals from accelerometer/IMU 304. For example, accelerometer/IMU 304 may provide signals to processing unit 126 indicative of accelerations experienced by sailing vessel 100, and when the acceleration of sailing vessel 100 exceeds a threshold, processing unit 126 may determine that sailing vessel 100 is operating in turbulent conditions. Processing unit 126 may, alternatively or in addition, compare sounds received by acoustic sensor 408, either through the air or underwater, with reference sounds stored by processing unit 126. Processing unit 126 may, alternatively or in addition, compare images from camera(s) 404 to reference images stored in processing unit 126 representative of rough sailing conditions. When a match is determined, processing unit 126 may determine that sailing vessel 100 is operating in rough seas.

Camera(s) 404 may provide raw or processed video or images to processing unit 126 and processing unit 126 may use the raw or processed video or images to detect a proximate threat, such as a hostile military vessel, aircraft or a large marine animal in the vicinity of sailing vessel 100, by comparing the video or images to representative images or video stored in processing unit 126. The term "proximate" as used herein, does not necessarily mean in close physical proximity to sailing vessel 100. Rather, "proximate" may mean tens or even hundreds of miles away, such as in the case of another sailing vessel or aircraft that can be detected by advanced detection means, such as acoustic sonars, lasers, radar, etc. Alternatively, or in addition, acoustic sensor 408 may provide raw or processed acoustic signals to processing unit 126 indicative of another vessel's engines, an aircraft engine, or a large marine animal. Acoustic sensor 408 may be passive, comprising a microphone (for receiving sounds above water 116) or hydrophone (for receiving sounds underwater) and in some embodiments amplification circuitry, while in other embodiments, acoustic sensor 408 may comprise an active sensor (i.e., a sonar sensor, sonar array, etc.) capable of emitting acoustic "pings" that reflect off of a target, such as a hostile vessel or large marine animal. Acoustic sensor 408 then provides the reflected signals to processing unit 126.

Once processing unit 126 has determined that sailing vessel 100 is operating in present or imminent inclement weather (i.e., "imminent" determined by monitoring signals from the components shown in FIG. 4 overtime and determining that the signals indicate worsening conditions, i.e., increased wave activity over time, increased wind speed over time, etc.), or that a proximate threat is present, processing unit 126 may cause sailing vessel 100 to submerge, either partially or fully, underwater, by controlling valves 130 and/or pump 134 to fill ballast tank 124, one or both outriggers, and/or hull 102 with water, causing sailing vessel 102 submerge. In one embodiment, one or more valves 130 are positioned so that a corresponding ballast tank, outrigger, or hull fills with water once valve(s) 130 is/are opened. In another embodiment, pump 134 is activated, causing water to be pumped inside ballast tank 124, one or both outriggers, and/or hull 102.

Processing unit 126 may determine that sailing vessel 100 has partially submerged underneath the water using signals from accelerometer/IMU 304, depth/pressure sensor 406, and/or camera(s) 404. For example, accelerometer/IMU 304 may provide signals indicating that sailing vessel 100 is at a particular angle, such as between 90 degrees and 60 degrees and with respect to vertical axis 302 for an extended period of time, such as 30 seconds or more, indicating that sailing vessel 100 has partially submerged, with at least a portion of mast 104 extending out of the water. Processing unit 126 may use signals from accelerometer/IMU 304 and/or depth/pressure sensor 406 to determine when sailing vessel 100 has completely submerged under the water.

Figure 5:
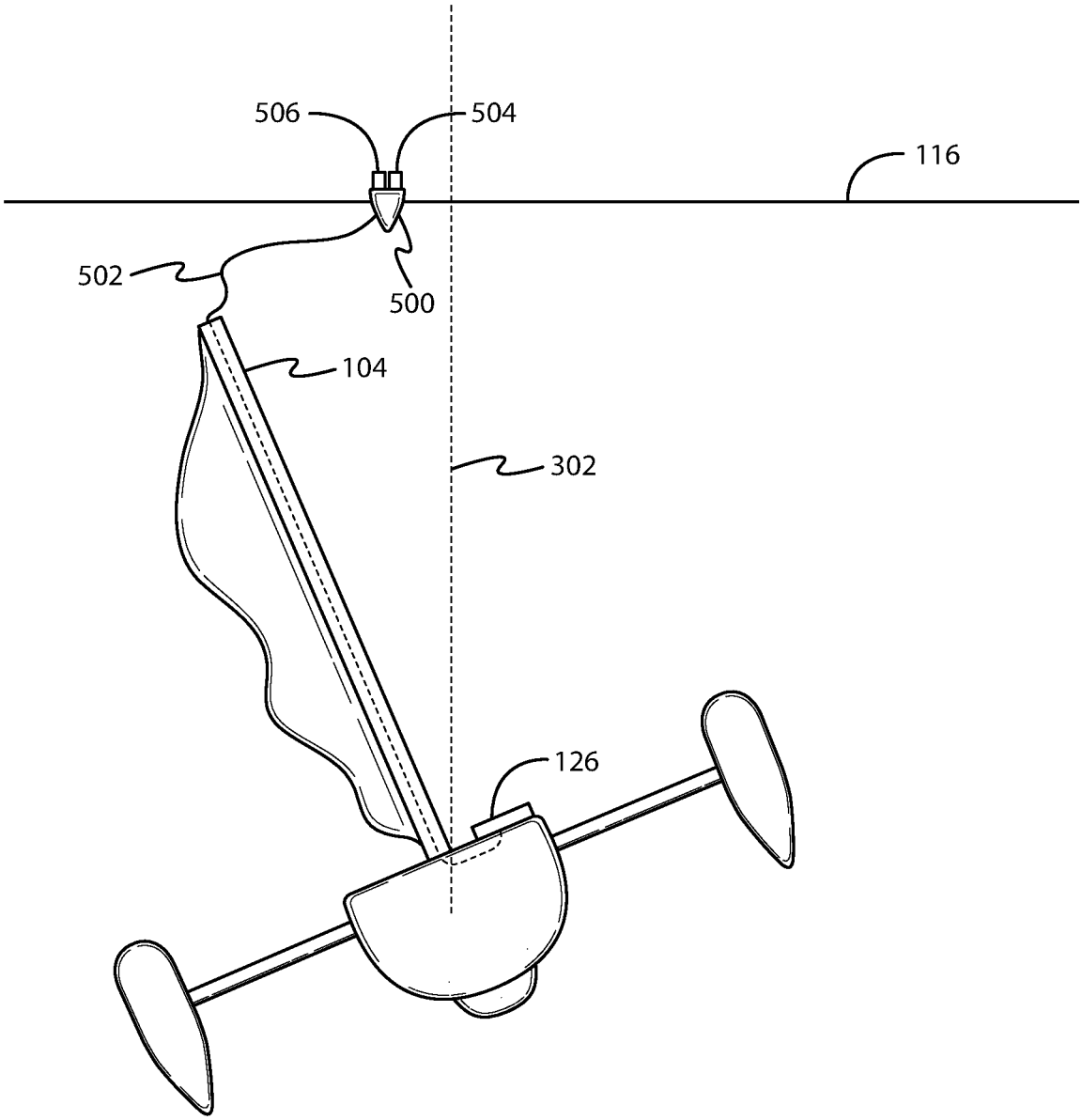
FIG. 5 is an aft view of the self-righting sailing vessel shown in FIGS. 1-3, shown completely submerged under water and deploying a buoy to the water's surface for detecting current or imminent weather and/or water conditions.

Processing unit 126 may cause sailing vessel 100 to maintain a certain depth, as reported by depth/pressure sensor 406, for a predetermined amount of time or upon the occurrence of a predefined event. For example, during a storm, processing unit 126 may cause sailing vessel 100 to submerge completely under water for a period of 12 hours, enough time to cause most storms to pass. Alternatively, or in addition, processing unit 126 may cause sailing vessel 100 to remain at the predetermined depth until processing unit 126 determines that a threat is no longer present. In this embodiment, one of which is shown in FIG. 5, sailing vessel 100 is completely submerged underneath water 116, and processing unit 126 may cause a buoy 500 to be released by sailing vessel 100, buoy 500 communicatively coupled to processing unit 126 via an insulated wire 502 and configured to float to a surface of the water. In other embodiments, buoy 500 is communicatively coupled to processing unit 126 via radio-frequency means, such as an RF transmitter or transceiver, acoustically via an acoustic transmitter and/or receiver, or by some other well-known means of communicating through water without the use of a wire.

Buoy 500 may be stowed near the top of mast 104 when not in use, with wire 502 routed through mast 104 to processing unit 126. Alternatively, buoy 500 could be stowed anywhere externally on sailing vessel 100, where wire 502 is coupled to processing unit 126 without routing through mast 104.

Buoy 500 may comprise sensor 506, comprising one or more accelerometers, wind detectors, wave detectors, acoustic sensors and/or cameras to sense, listen and/or view whether a threat is still present. Buoy 500 sends signals to processing unit 126 indicative of any accelerations experienced by buoy 500, sounds or visual images captured by buoy 500, and processing unit 126 compares the accelerations, sounds or visual images to one or more predetermined accelerations, sounds or visual images stored therein to determine whether a threat still remains present. If so, processing unit 126 may continue to hold sailing vessel 100 at the predetermined depth by introducing compressed gas into ballast tank 124, one or both outriggers and/or hull 102 and/or by allowing water into ballast tank 124, one or both outriggers and/or hull 102 via one or more valves 130. Any well-known means and methods may be used to evacuate ballast tank 124, one or both outriggers and/or hull 102 when processing unit 126 determines to increase the buoyancy of sailing vessel 100, such as by mechanically moving a partition within ballast tank 124, one or both outriggers and/or hull 102. If the threat has passed, processing unit 126 may cause sailing vessel 100 to begin resurfacing, by causing ballast tank 124, one or both outriggers, and/or hull 102 to fill with a compressed gas stored in a compressed gas tank 410 either inside hull 102 or attached thereto. Compressed gas tank 410 may be controlled by an electromechanical valve and compressed gas from compressed gas tank for 10 is provided to either ballast tank 124, one or both outriggers and/or hull 102 via one or more tubes, pipes, or hoses (not shown).

In one embodiment, buoy 500 comprises an RF or satellite receiver, and/or RF or satellite transceiver 504, where the receiver may receive a wireless command from a remote source for sailing vessel 100 to submerge or remain submerged. Processing unit 126 receives the command, and in response, causes sailing vessel 100 to remain submerged. In one embodiment, the command additionally comprises a time for sailing vessel 100 to remain submerged, such as for three hours, or a certain time for sailing vessel 102 to surface. In response, processing unit 126 either holds sailing vessel 100 in a completely or partially submerged position for three hours before again determining whether it is safe and/or desirable for sailing vessel 100 to surface, or processing unit 126 determines that the prescribed time has arrived, and begins a process to begin resurfacing sailing vessel 100.

In a related embodiment, buoy 500 may receive current or predicted weather conditions for an area proximate to sailing vessel 100 via the receiver/transmitter/transceiver 504. Processing unit 126 receives the current and/or predicted weather conditions, and if the present and/or predicted weather conditions indicate that it is safe to sail, i.e., the wind and/or the waves are, or will be, less than predetermined thresholds stored in memory 602, processing unit 126 may begin the process of resurfacing sailing vessel 100. If the present and/or predicted weather conditions are not favorable to sailing, i.e., the wind and/or the waves are, or will be, greater than predetermined thresholds stored in memory, processing unit 126 may continue to wait and hold sailing vessel 100 at depth until a later time, when processing unit 126 may again determine whether conditions are safe for sailing vessel 100 to surface.

In another related embodiment, processing unit 126 may cause buoy 500 to transmit a signal to a remote location, with information regarding sailing vessel 100 or conditions surrounding sailing vessel 100. For example, processing unit 126 may cause buoy 500 to transmit a current location of sailing vessel 100, one or more statuses of one or more systems on board sailing vessel 100, a fuel level, current environmental conditions such as a magnitude and/or direction of the wind (i.e., wind speed), wave height, sounds, and/or any images and/or video captured by camera(s) 404. Processing unit 126 may additionally, or alternatively, transmit and inquiry to the remote location, asking whether or not sailing vessel 100 should surface. In response to transmitting the information regarding sailing vessel 100 or its current sailing environment, or in response to transmitting the inquiry, processing unit 126 may receive a response from the remote location, commanding processing unit 126 to begin resurfacing sailing vessel 100 immediately, or at some other time, or to remain at a current depth or move to a different depth, either deeper or shallower than a present depth of sailing vessel 100.

Processing unit 126 monitors an attitude of sailing vessel 100 to ensure that when sailing vessel 100 begins to surface, it is positioned at or near an upright position, i.e., mast 104 extending upwards within a predetermined angle from vertical axis 302. This helps to ensure that sailing vessel 100 will emerge from the water in an upright position, and upon full resurfacing, able to continue sailing on top of the water. While submerged, sailing vessel 100 generally maintains an upright or near-upright position, with mast 104 within a predetermined angle of vertical axis 302, for example, 20 degrees, due to the design of the rig, which is much more buoyant than the outriggers and hull 102 when the outriggers and hull 102 are submerged. When processing unit 126 determines that it is time for sailing vessel 102 to surface, processing unit 126 causes sailing vessel 100 to begin ascending so long as mast 104 (i.e., the attitude of sailing vessel 100) is within the predetermined angle. When mast 104 is not within the predetermined angle, processing unit 126 may halt the ascent of sailing vessel 100 and wait until sailing vessel 100 re-establishes its attitude within the predetermined angle.

Processing unit 126 continues allowing sailing vessel 100 to ascend and eventually surface. Processing unit 126 may determine that sailing vessel 100 has completely surfaced when one or more of the components of FIG. 4 indicates such. For example, processing unit 126 may begin reading signals from wind detector 400, use images or video from camera(s) 404, or signals from accelerometer/IMU 304 to determine when resurfacing has been completed.

Figure 6:
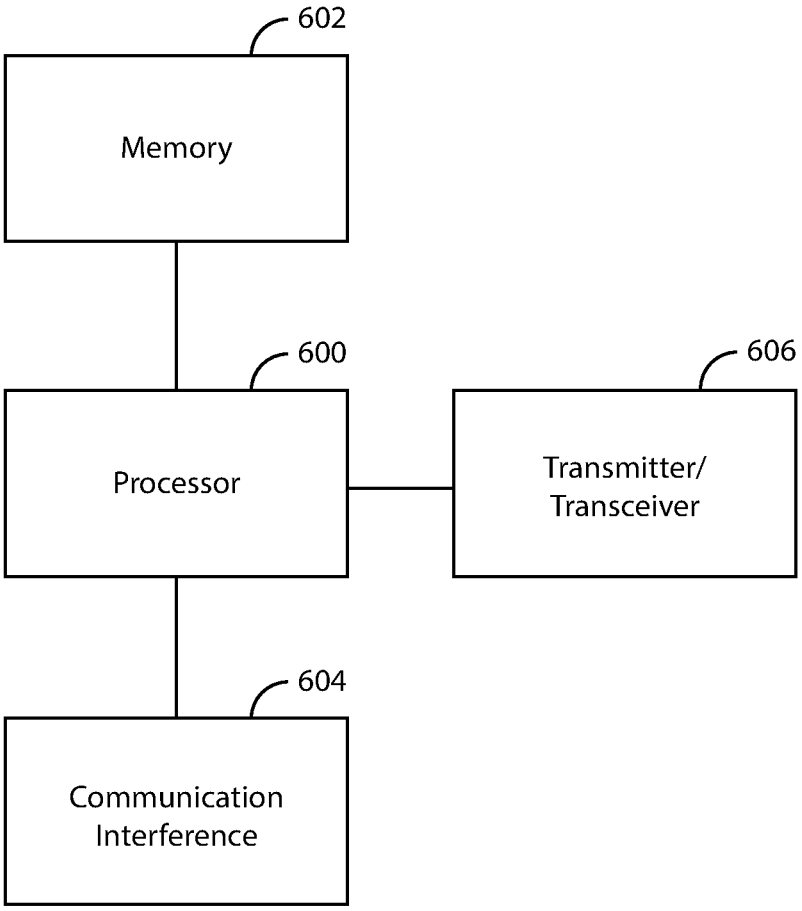
FIG. 6 is a functional block diagram of one embodiment of the processing unit shown in FIG. 4, comprising a processor, a non-transitory memory, and a communication interface.

FIG. 6 is a functional block diagram of one embodiment of processing unit 126, comprising processor 600, memory 602, and communication interface 604. It should be understood that the functional blocks shown in FIG. 6 could be arranged in different manners in other embodiments, and that some basic functional blocks have been omitted, such as a power supply, for clarity.

Processor 600 is configured to provide general operation of processing unit 126 by executing processor-executable instructions stored in memory 602, for example, executable code. Processor 600 comprises one or more general or special-purpose microprocessors, microcontrollers, discreet components and/or ASICs, such as any one of a number of Core i-series class microprocessors manufactured by Intel Corporation of Santa Clara, California, chosen based on operating requirements such as power, speed, size and cost.

Memory 602 comprises one or more non-transitory information storage devices, such as RAM, ROM, EEPROM, flash memory, or virtually any other type of electronic, mechanical, or optical storage device. Memory 602 is used to store the processor-executable instructions for operation of processing unit 126 as well as any information used by processor 600 to perform such operations. Such information may comprise threshold information, a maximum-permitted attitude angle used during resurfacing to ensure sailing vessel 100 maintains an upright or near-upright attitude while resurfacing, representative image information, representative video information, representative acoustic information, one or more predetermined depths, one or more predetermined times for maintaining a predetermined depth, and other information necessary to the operation of sailing vessel 100. In some embodiments, at least a portion of memory 602 is incorporated into processor 600, such as the case in embodiments where processor 600 comprises a microcontroller, custom ASIC or some other processing device having an on-board memory.

Communication interface 604 is coupled to processor 600, comprising circuitry necessary for processor 600 to electronically communicate with the components shown in FIG. 4. Such circuitry as well-known in the art.

Figure 7:
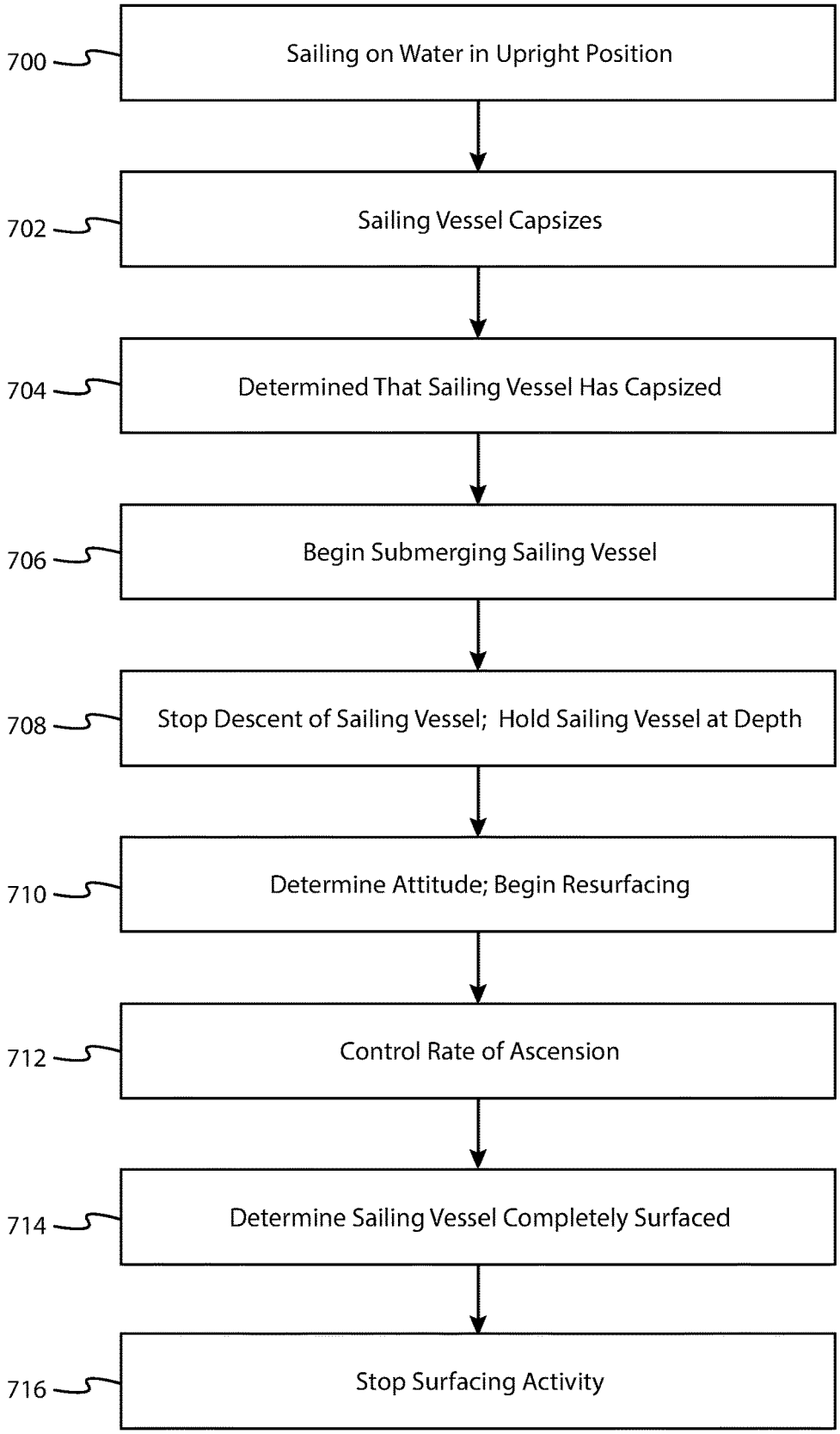
FIG. 7 is a flow diagram illustrating one embodiment of a method, performed by the processor shown in FIG. 6, for detecting that sailing vessel has capsized and autonomously recovering it.

FIG. 7 is a flow diagram illustrating one embodiment of a method, performed by processor 600, for detecting that sailing vessel 100 has capsized or submerged and autonomously recovering it. It should be understood that in some embodiments, not all of the method steps shown in FIG. 6 are performed, and that the order in which the steps are performed may be different in other embodiments. It should also be understood that some of the methods described in FIG. 7 may be applied to the method as described in FIG. 9 and its related description.

At block 700, sailing vessel 100 is sailing on a surface of water 116 in an upright position, with mast 104 extending from hull 102 towards the sky, as shown in FIG. 1.

At block 702, sailing vessel 100 capsizes due to heavy winds, large waves, or some other reason. When capsized, sailing vessel 100 generally assumes the position as shown in FIG. 2 for a multi-hull vessel, with hull 102 partially or completely submerged under water 116 and a portion of mast 104 remaining above water 116. In some cases, hull 102 may lie closer to a surface of water 116 when hull 102 possesses a particular buoyancy greater than a buoyancy of hull 102 as shown in FIG. 2.

At block 704, processor 600 of processing unit 126 determines that sailing vessel 100 has capsized. Processor 600 may receive raw or processed signals from accelerometer/IMU 304 or inclinometer 412, indicating that sailing vessel 100 is at an inclination suggestive of sailing vessel 100 being capsized, i.e., that sailing vessel 100 remains at an attitude greater than a predetermined angle, such as 70° from vertical axis 302, or that sailing vessel 100 is lying at an attitude of approximately 90 degrees of roll, with mast 104 essentially horizontal on the surface of water 116, or that sailing vessel 100 has been rolled a full 180 degrees with mast 104 positioned vertically downwards, or that sailing vessel 100 has been rolled anywhere in between 90 degrees and 180 degrees. Processor 600 may, alternatively or in addition, determine that sailing vessel 100 has capsized by processing signals from wind detector 400 (i.e., no further indications of wind), depth/pressure sensor 406 (i.e., hull 102 is beneath a surface of water 116), and/or images and/or video from camera(s) 404 indicating that sailing vessel 100 has been capsized.

At block 706, in response to determining that sailing vessel 100 has been capsized, processor 600 may purposely begin submerging sailing vessel 100. Hull 102 is typically configured to be watertight so that it may be completely submerged beneath a surface of water 116. To begin submerging sailing vessel 100, processor 600 may cause one or more valves 130 to open, allowing water to fill one or more of ballast tank 124, one or more of the outriggers and/or hull 102. Alternatively, processor 600 may cause pump 134 to begin pumping water into ballast tank 124, one or more of the outriggers and/or hull 102. As a result of submerging hull 102, the entire sailing vessel 100, including the rig, may be submerged under water. In another embodiment, during a partial submersion, hull 102 is completely submerged underwater, while at least a portion of mast 104 and/or sale 106 remains above the surface of water 116, exposed to air.

Figure 8:
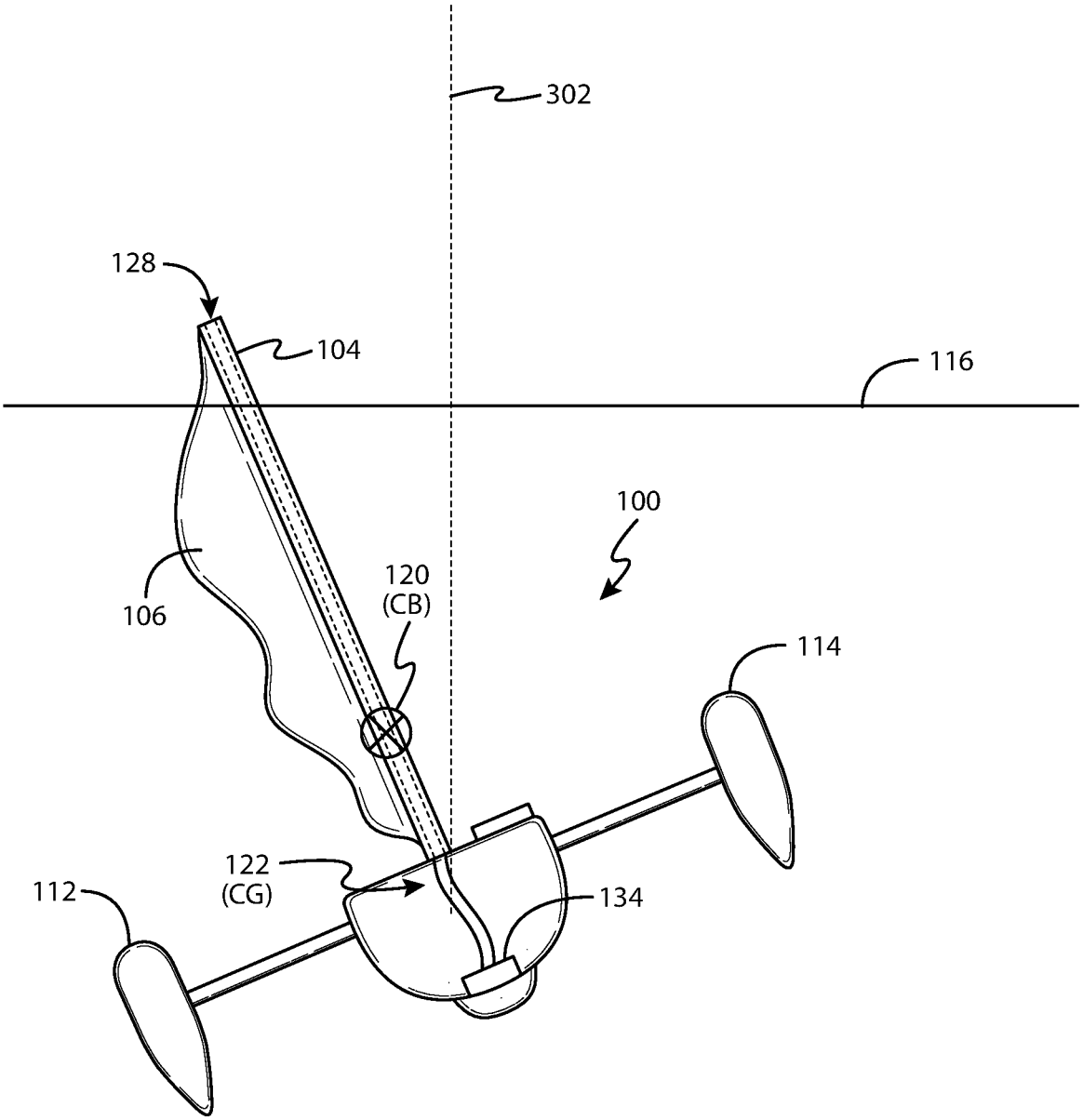
FIG. 8 is an aft view of the self-righting sailing vessel shown in FIGS. 1-3 and 5, shown holding at a predetermined depth.

At block 708, processor 600 determines when to stop sailing vessel 100 from descending further into the water and hold sailing vessel 100 at a predetermined depth. FIG. 8 illustrates a position of sailing vessel 100 when it has been partially submerged. In FIG. 8, sailing vessel 100 (i.e., hull 102) is shown at a depth of about 15 feet, resulting in a pressure of about 6.5 PSI, at an attitude of about 18° from vertical 302, with a distal and of mast 104 extending slightly above the surface of water 116. Processor 600 may use signals from depth/pressure sensor 406 and compare the depth or pressure to a predetermined depth or pressure stored in memory 602. In another embodiment, processor 600 causes sailing vessel 100 to stop descending when processor 600 determines that an attitude of sailing vessel 100 is less than a predetermined attitude as stored in memory 602, such as 20 degrees. In this embodiment, as hull 102 submerges, the center of buoyancy 120 of sailing vessel 100 moves from the position shown in FIG. 1 to the position shown in FIG. 7, much higher than the center of gravity 122, which remains unchanged when telling vessel 100 is in a submerged state. The center of buoyancy 120 moves because the buoyancy of the outriggers and/or hull 102 virtually disappears when the outriggers and/or hull 102 are filled with water, and because the rig is purposely designed to be more buoyant than prior art rigs. This creates a righting moment on sailing vessel 100, causing sailing vessel 100 to become more upright while fully, or partially, submerged.

When the predetermined depth, pressure or attitude is reached, processor 600 may cause one or more valves 130 to close, thus preventing any further water from entering ballast tank 124, one or more of the outriggers and/or hull 102. In another embodiment, in addition to closing valve(s) 130, processor 600 may cause compressed gas from compressed gas tank 410 to be released into ballast tank 124, one or more of the outriggers and/or hull 102, until processor 600 determines that sailing vessel 100 is neutrally buoyant, i.e., that sailing vessel 100 is neither ascending nor descending in the water.

At block 710, in response to determining that sailing vessel 100 is less than the predetermined attitude, or that hull 102 is at the predetermined depth or pressure, processor 600 may begin to cause sailing vessel 100 to surface. Typically, processor 600 causes compressed air from compressed gas tank 410 to begin filling ballast tank 124, one or more of the outriggers and/or hull 102, until processor 600 determines that sailing vessel 100 is positively buoyant, i.e., that sailing vessel 100 is ascending. In one embodiment, processor 600 controls the release of the compressed gas such that the attitude of sailing vessel 100 is kept within predetermined angle 300 in an upright or semi-upright position. This may be accomplished by processor 600 causing more compressed gas to enter, for example outrigger 112 versus outrigger 114. Processor 600 may continue to monitor the attitude of sailing vessel 100 to ensure that it at least remains at an attitude less than the predetermined attitude stored in memory 602 and, in one embodiment, less than a second predetermined attitude, also stored in memory 602, that is less than the predetermined attitude, for example, 10 degrees. Use of the second predetermined attitude better assures that sailing vessel 100 will surface properly, in an upright position. If sailing vessel 100 deviates from the predetermined attitude(s), processor 600 may attempt to correct such deviation by again controlling the amount of compressed gas entering one or both outriggers and/or allowing some water to enter ballast tank 124, one are both outriggers, or hull 102.

In another embodiment, processor 600 does not monitor the attitude of sailing vessel 100 during ascension. In this embodiment, compressed air is introduced by processor 600 into at least one of the outriggers via a valve 130 on one or both of the outriggers. For example, in one embodiment, outrigger 112 and hull 102 are hollow and each comprises valve 130, while outrigger 114 is not capable of receiving or holding compressed air and is very buoyant, i.e., having enough buoyancy so that outrigger 114 is above the rest of sailing vessel 100 when sailing vessel 100 is completely submerged. Due to outrigger 114 being very buoyant, sailing vessel will hold a depth underwater, or rest on a bottom of a sea or ocean, at an angle as shown in FIG. 5, for example, with outrigger 114 attempting to raise sailing vessel 100 due to its very buoyant construction. When processor 600 determines to surface sailing vessel, processor 600 introduces compressed gas into outrigger 112 and/or hull 102, forcing water out of outrigger 112 and/or hull 102, causing sailing vessel 100 overall to become more buoyant. At some point, sailing vessel 100 begins to ascend. When sailing vessel 100 reaches the surface, outrigger 114 and distal portion 132 of mast 104 may be exposed to the air, while outrigger 112 may be fully submerged still. At this point, processor 600 may continue causing compressed gas to enter outrigger 112 and/or hull 102, forcing the remaining water out of outrigger 112 and/or hull 102 and causing outrigger 112 and/or hull 102 to continue surfacing until both outriggers and hull 102 are resting on the surface of the water. In a related embodiment, both outriggers are configured to take in water and compressed gas under the direction of processor 600. In this embodiment, one or both of the outriggers are flooded with water by processor 600 when processor 600 determines to submerge sailing vessel 100. When resurfacing, processor 600 causes compressed gas to enter one or both of the outriggers, causing sailing vessel 100 to ascend to the surface, albeit likely in tilted position until one of the outriggers is exposed to the air, for example, the position shown in FIG. 2. Processor 600 may then determine an inclination or attitude of sailing vessel 100 using accelerometer/IMU 304, inclinometer 412, or some other component shown in FIG. 4, and, in response, cause compressed air to enter whichever outrigger is fully submerged. Processor 600 may continue to cause compressed gas to enter the fully submerged outrigger until it has surfaced and in horizontal alignment with the other outrigger that surfaced first.

In a related embodiment, processor 600 does not cause sailing vessel 102 to submerge when it determines that sailing vessel 100 has capsized. In this embodiment, both outriggers may hold a predetermined amount of water or other liquid ballast, such as being filled ¼ with such water or other liquid ballast. When capsized, one of the outriggers will typically be floating on the surface of water 116, while the other outrigger is generally submerged underneath water 116. In this embodiment, processor 600 simply determines an inclination or an attitude of sailing vessel 100 and increases a buoyancy of the outrigger that is completely submerged, based on a knowledge of the inclination or attitude of sailing vessel 100. For example, if sailing vessel 100 lies capsized on water 116 to the starboard, outrigger 114 is underwater while outrigger 112 is exposed to the air. Knowing the inclination or attitude, processor 600 determines that outrigger 114 is submerged underwater and, in response, causes the buoyancy of outrigger 114 to increase. This is typically accomplished by forcing compressed gas from compressed gas tank 410 into outrigger 114 via valve 130, causing outrigger 114 to expel some or all of the water or other liquid ballast, thus causing outrigger 114 to surface and thereby righting sailing vessel 100. When sailing vessel 100 has been completely righted, processor 600 may cause outrigger 114 to open valve 130, or another valve, to allow water to re-enter outrigger 114 until it is filled to the desired amount, in this case, ¼ capacity, to match outrigger 112.

At block 712, in one embodiment, during ascension, processor 600 monitors a rate of ascent of sailing vessel 100 and may control a rate of ascent to match a predetermined ascent rate stored in memory 602. Processor 600 may determine the rate of ascent using information from depth/pressure sensor 406 or accelerometer/IMU 304. During ascent, sailing vessel 100 generally rises such that an attitude of mast 104 is within predetermined angle 300 and or the second predetermined attitude.

At block 714, sailing vessel 100 fully surfaces in an upright position, ready to continue sailing. Processor 600 determines that sailing vessel 100 has fully surfaced using signals from depth/pressure sensor 406, accelerometer/IMU 304, wind detector 400, acoustic sensor 408 and/or camera(s) 404.

At block 716, in response to determining that sailing vessel 100 has fully surfaced, processor 600 may stop causing sailing vessel 100 from continuing to surface. This may comprise processor 600 stopping compressed air from entering ballast tank 124, one or both of the outriggers, and/or hull 102 and/or opening valve(s) 130.

Figure 9A:
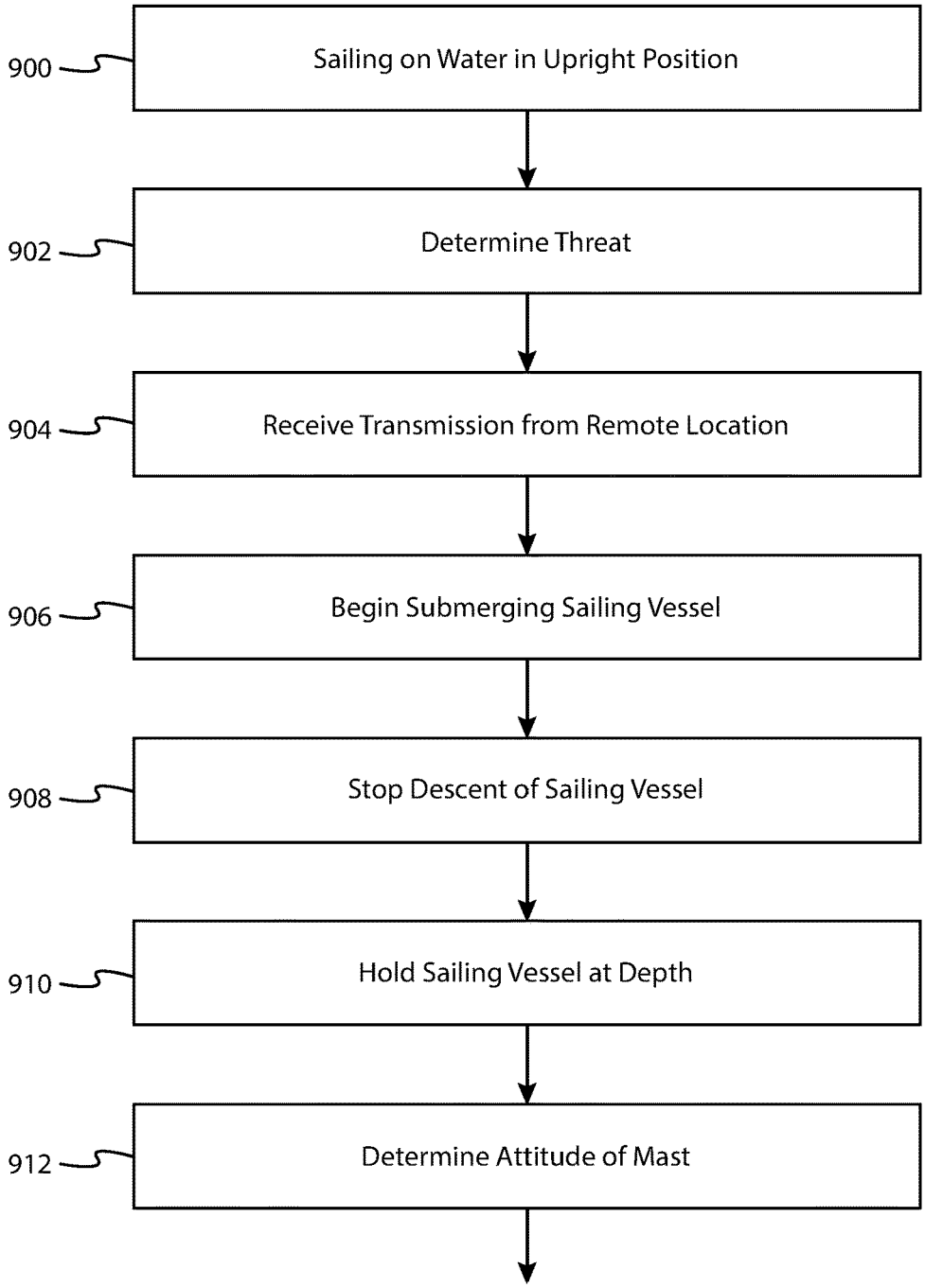
FIGS. 9A and 9B represent a flow diagram illustrating one embodiment of a method, performed by the processor shown in FIG. 6, for detecting a threat to the self-righting sailing vessel shown in FIGS. 1-3, 5 and 8, submerging the self-righting sailing vessel, and causing the self-righting sailing vessel to surface at some later time.
Figure 9B:
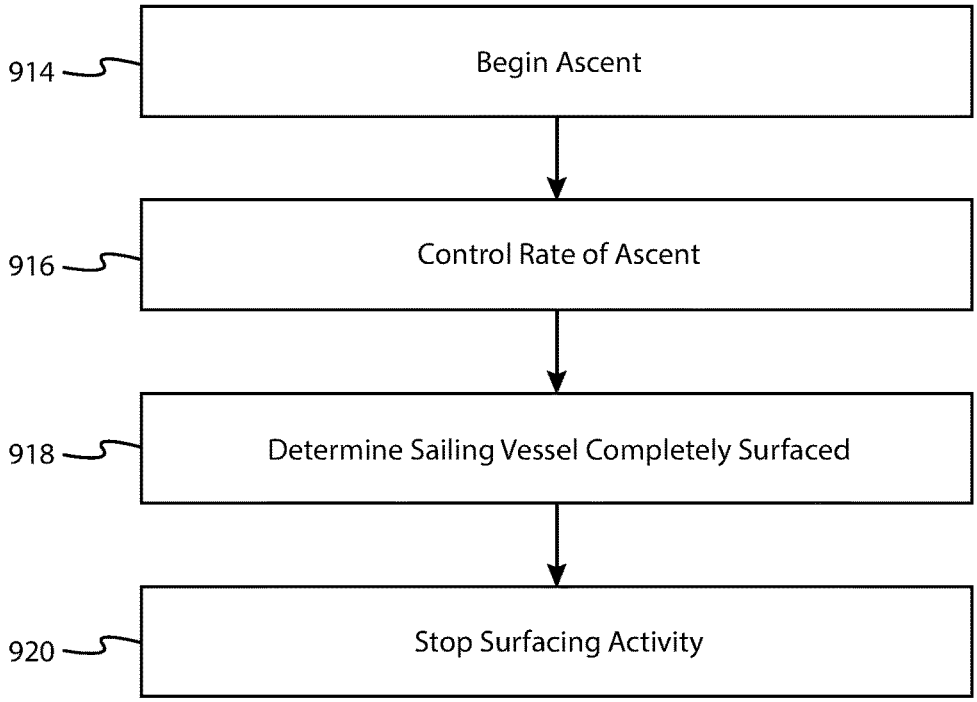

FIGS. 9A and 9B represent a flow diagram illustrating one embodiment of a method, performed by processor 600, for detecting a threat to sailing vessel 100, submerging sailing vessel 102 in response to the threat, and causing sailing vessel 100 to surface at some later time, typically when the threat has passed. It should be understood that in some embodiments, not all of the method steps shown in FIG. 9 are performed, and that the order in which the steps are performed may be different in other embodiments.

At block 900, sailing vessel 100 is sailing on water 116 in an upright position, with mast 104 extending from hull 102 towards the sky.

At block 902, processor 600 determines that sailing vessel 100 is under a present or imminent threat. A threat may comprise inclement weather, such as a hurricane, waterspout, or more generally, a storm. The threat may, additionally or alternatively, comprise another vessel or large marine animal in proximity to sailing vessel 100. The threat may, additionally or alternatively, comprise an aircraft flying within a predetermined range of sailing vessel 100, such as an enemy helicopter or fixed-wing aircraft.

To detect inclement weather, processor 600 may process signals from wind detector 400, wave detector 402, accelerometer/IMU 304 and/or camera(s) 404. For example, if the wind exceeds a predetermined threshold as stored in memory 602, and in some embodiments, for greater than a predetermined time period, processor 600 may determine that a weather threat is imminent or present. Determining that a weather threat is imminent may comprise processor 600 comparing signals from wind detector 402 a number of thresholds stored in memory 602, each threshold indicating a greater wind force. As the wind velocity increases as detected by wind detector 400, processor 600 determines that a first of these thresholds is exceeded. Then, as another threshold is exceeded within a predetermined time period, processor may determine that the weather is getting worse, and in response, choose to submerge sailing vessel 100. Similarly, processor 600 may process signals from wave detector 402 to determine when the waves are getting very large, and potentially capable of capsizing sailing vessel 100. As with wind detector 400, processor 600 may process signals from wave detector 402 and compare the signals to one or more thresholds stored in memory 602. In some embodiments, processor 600 utilizes signals from both wind detector 400 and wave detector 402 and determines a present or imminent threat based on the signals from both sensors.

Alternatively, or in addition, to using the signals from wind detector 400 and/or wave detector 402, processor 600 may determine a present or imminent weather threat by processing signals from accelerometer/IMU 304. Accelerometer/IMU 304 may provide signals indicative of one or more accelerations of sailing vessel 100, i.e., as sailing vessel 100 is being rolled and pitched by the wind and/or waves. Accelerometer/IMU 304 may also provide an attitude of sailing vessel 100, indicating how far over sailing vessel 100 has been rolled by the wind and/or waves. Processor 600 may use the signals from accelerometer/IMU 304 and compare them to one or more predetermined thresholds stored in memory 602 to determine when sailing vessel 100 is being rolled over significantly. For example, if sailing vessel 100 experiences accelerations greater than 20 $m/s^2$ over a predetermined time period, such as five minutes, processor 600 may determine that sailing vessel 100 is under a present or imminent weather threat. As another example, if accelerometer/IMU 304 indicates that the attitude of sailing vessel 100 has exceeded a predetermined angle, such as 70°, either several times in succession, or for a predetermined number of times over a predetermined time period, such as four times in one minute, processor 600 may determine that a present or imminent weather threat exists.

Processor 600 may, in addition or alternatively to the processes described above, utilize signals from camera(s) 404 to determine a present or imminent weather threat. In this embodiment, processor 600 receives images and/or video from camera(s) 404 and compares the images and/or video to reference images and/or video stored in memory 602. The reference images and/or video may comprise images and/or video of what the sky may look like before, or during, a storm, such as dark skies, lightning, dark clouds, rain, etc.

Processor 600 may, additionally or alternatively to detecting a weather threat, determine that a proximate threat, such as a current or imminent presence of a vessel or large marine animal in proximity to sailing vessel 100. Processor 600 may detect such present or imminent proximate threat using signals from acoustic sensor 408, camera(s) 404 and/or one or more other sensors. Processor 600 may receive raw or processed video and/or images from camera(s) 404 and compare the video and/or images to representative images and/or video of one or more large vessels, such as an aircraft carrier, destroyer, cargo ship, etc., or images and/or video of a whale breaching the surface of water 116, stored in memory 602.

Alternatively, or in addition, processor 600 may receive raw or processed acoustic signals from acoustic sensor 408 and compare the signals to reference sounds stored in memory 602. The reference sounds stored in memory 602 may be indicative of another vessel's engines, an aircraft engine, a helicopter rotor, or the sounds typically produced by a large marine animal. Acoustic sensor 408 may be passive, comprising one or more microphones and/or hydrophones and, in some embodiments, amplification circuitry, while in other embodiments, acoustic sensor 408 may comprise one or more active sensors capable of emitting acoustic "pings" that reflect off of a target, such as a hostile vessel or large marine animal. Processor 600 processes the pings and may determine proximity of a vessel or large marine animal by determining how quickly pings are being returned to acoustic sensor 408. Additionally, processor 600 may determine that a vessel or large marine animal is approaching sailing vessel 100 when the round-trip time of the pings decreases over time.

At block 904, processor 600 may receive a transmission from a remote source, such as a satellite, a land-based transmitter, or another vessel, via transmitter/transceiver 606, commanding sailing vessel 100 to submerge. The command may be a result of the remote source determining that a threat exists, or is imminent.

At block 906, in response to determining a present or imminent threat, or upon receipt of a command to submerge sailing vessel 100, processor 600 may purposely begin submerging sailing vessel 100. To begin submerging sailing vessel 100, processor 600 may cause one or more valves 130 to open, allowing water to fill one or more of ballast tank 124, one or more of the outriggers and/or hull 102. Alternatively, processor 600 may cause pump 134 to begin pumping water into ballast tank 124, one or more of the outriggers and/or hull 102.

At block 908, processor 600 determines when to stop sailing vessel 100 from descending further into the water and hold sailing vessel 100 at a predetermined depth based on a predetermined depth, pressure or attitude, as described previously. Sailing vessel 100 may be completely, or partially, submerged.

When the predetermined depth, pressure or attitude is reached, processor 600 may cause one or more valves 130 to close, thus preventing any further water from entering ballast tank 124, one or more of the outriggers and/or hull 102. In another embodiment, in addition to closing valve(s) 130, processor 600 may cause compressed gas from compressed gas tank 410 to be released into ballast tank 124, one or more of the outriggers and/or hull 102, until processor 600 determines that sailing vessel 100 is neutrally buoyant, i.e., that sailing vessel 100 is neither ascending nor descending in the water.

At block 910, processor 600 may hold sailing vessel 100 at a predetermined depth for a predetermined amount of time. In one embodiment, processor 600 holds sailing vessel 100 at the predetermined depth for a predetermined, fixed amount of time, such as 12 hours, or enough time for a typical storm, vessel or large marine animal to pass. In another embodiment, processor 600 holds sailing vessel 100 at the predetermined depth until processor 600 determines that it is safe and/or desirable to surface, or upon instructions to surface from a remote location, for example, via buoy 500. In this embodiment, processor 600 may determine one or more conditions of water 116 and/or an environment surrounding an area where sailing vessel 100 had submerged.

For example, in one embodiment, processor 600 may release buoy 500, which ascends to the surface of water 116. As described previously, buoy 500 may comprise one or more of an accelerometer, a wind detector, a wave detector, a microphone for capturing acoustic sounds, a camera and/or a receiver, transmitter and/or transceiver 504. Buoy 500 sends signals to processor 600 indicative of a magnitude and/or direction of acceleration, wind speed, wave height, sounds and/or images and/or video experienced by buoy 500 while floating on the surface of water 116. Processor 600 receives the signals and compares information in the signals to one or more predetermined thresholds stored in memory 602. For example, if processor 600 receives acceleration signals from buoy 500 indicating that buoy 500 is being tossed about in rough water, processor 600 may determine that it is unsafe and/or undesirable to surface. On the other hand, if the signals from buoy 500 indicate that the wind and the waves are less than predetermined values as stored in memory 602, processor 600 may determine that it is safe and/or desirable to cause sailing vessel 100 to surface.

In a related embodiment, buoy 500 may comprise a receiver, or a transceiver, for receiving wireless communication signals from a remote source, such as a satellite, a ground-based transmitter or another vessel. Buoy 500 may receive a wireless communication indicating that the weather proximate to sailing vessel 100 is presently, or imminently, safe to sail, i.e., buoy 500 may receive current or predicted wind and/or wave information and provide the information to processor 600 via wire 502 or by RF, acoustic or some other transmission means. Processor 600 may then determine, based on the current and/or predicted wind and wave information that it is either unsafe and undesirable to surface (i.e., when the waves and/or the wind is greater than predetermined thresholds stored in memory 602), or that it is safe and/or desirable to surface (i.e, when the waves and/or the wind is less than predetermined thresholds stored in memory 602).

In another embodiment, processor 600 may determine that it is safe and/or desirable to surface by causing sailing vessel 102 ascend to a depth such that at least a portion of mast 104 is protruding from the surface of water 116, as shown in FIG. 8. In this embodiment, distal end 132 of mast 104 may comprise components of buoy 500, described previously, i.e., an accelerometer, wind detector, wave detector, acoustic detector, and/or a camera electronically coupled to processor 600. When at the predetermined depth, one or more of these components protrude from the surface of water 116, allowing the components to measure/view various conditions in an area around sailing vessel 100, such as wind speed, wave height, clouds, lightning, dark skies, rough water, etc. Processor 600 uses signals from these components to determine whether or not to completely cause sailing vessel 100 to surface. The determination generally comprises processor 600 comparing the information in the signals to predetermined thresholds stored in memory 602, as previously described. In one embodiment, when processor 600 determines it is not safe and/or desirable to surface, it may cause sailing vessel 102 again descend to a predetermined depth and continue waiting for a predetermined amount of time before rechecking conditions for another attempt at resurfacing.

At block 912, processor 600 may determine an attitude of sailing vessel 100, i.e., mast 104, via accelerometer/IMU 304 and/or inclinometer 412. This is typically done periodically while sailing vessel 100 is submerged.

At block 914, when processor 600 has determined it is time, or safe, for sailing vessel 100 to begin resurfacing, and the attitude of mast 104 is less than the predetermined attitude, processor 600 may begin to cause sailing vessel 100 to surface. Typically, processor 600 causes compressed air from compressed gas tank 410 to begin filling ballast tank 124, one or more of the outriggers and/or hull 102, until processor 600 determines that sailing vessel 100 is positively buoyant, i.e., that sailing vessel 100 is ascending. Other well-known methods and means may be used to cause sailing vessel 100 to surface. In one embodiment, processor 600 controls the release of the compressed gas such that the attitude of sailing vessel 100 remains within predetermined angle 300, either side-to-side, bow to stern, or any combination therebetween. This may be accomplished by processor 600 causing more compressed gas to enter, for example outrigger 112 versus outrigger 114. Processor 600 may continue to monitor the attitude of sailing vessel 100 to ensure that it at least remains at an attitude less than predetermined angle 300 stored in memory 602 and, in one embodiment, less than a second predetermined attitude, also stored in memory 602, that is less than the predetermined attitude, for example, 10 degrees. Use of the second predetermined attitude better assures that sailing vessel 100 will surface properly, in an upright position. If sailing vessel 100 deviates from the predetermined attitude(s), processor 600 may attempt to correct such deviation by again controlling the amount of compressed gas entering one or both outriggers and/or allowing some amount of water to re-enter ballast tank 124, one or both outriggers and/or hull 102.

At block 916, in one embodiment, processor 600 monitors a rate of ascent of sailing vessel 100 as it ascends and controls the rate of ascent to match a predetermined ascent rate stored in memory 602. Processor 600 may determine the rate of ascent using information from depth/pressure sensor 406, accelerometer/IMU 304 and/or other sensors. During ascent, sailing vessel 100 generally rises such that mast 104 is within predetermined angle 304 and, in some embodiments, and/or the second predetermined attitude.

At block 918, sailing vessel 100 fully surfaces in an upright position, ready to continue sailing. Processor 600 determines that sailing vessel 100 has fully surfaced using signals from depth/pressure sensor 406, accelerometer/IMU 304, wind detector 400, acoustic sensor 408 and/or camera(s) 404.

At block 920, in response to determining that sailing vessel 100 has fully surfaced, processor 600 may stop causing sailing vessel 100 from continuing to surface. This may comprise processor 600 stopping compressed air from entering ballast tank 124, one or both of the outriggers, and/or hull 102 and/or opening valve(s) 130.

While the foregoing disclosure shows illustrative embodiments of the invention, it should be noted that various changes and modifications could be made herein without departing from the scope of the embodiments as defined by the appended claims. Furthermore, although elements of the invention may be described or claimed in the singular, the plural is contemplated unless limitation to the singular is explicitly stated.

We claim:

1. A method for autonomous submerging and resurfacing of a sailing vessel, comprising:

determining, by a processor of the sailing vessel, an occurrence of a predetermined event;

in response to determining the occurrence, causing, by the processor, a hull of the sailing vessel to completely submerge beneath water;

determining, by the processor, that an attitude of a mast of the sailing vessel is less than a predetermined angle; and in response to determining that the attitude of the mast is less than the predetermined angle, causing, by the processor, the hull to surface.

2. The method of claim 1, further comprising:

determining, by the processor, that the hull is at least partially exposed to air while the hull is resurfacing; and in response to determining that the hull is at least partially exposed to the air, causing, by the processor, the hull to stop resurfacing.

3. The method of claim 1, further comprising:

while resurfacing, determining, by the processor, that the attitude of the mast is not within the predetermined angle; and causing, by the processor, the sailing vessel to stop resurfacing when the attitude of the mast is not within the predetermined angle.

4. The method of claim 1, wherein causing the sailing vessel to begin resurfacing comprises:

causing, by the processor, compressed air from a compressed air tank of the sailing vessel to enter an outrigger, a ballast tank and/or the hull of the sailing vessel.

5. The method of claim 1, wherein causing the sailing vessel to surface comprises:

pumping, by a pump coupled to the processor, ambient air into an outrigger, a ballast tank, and/or the hull of the sailing vessel, the ambient air received by the pump via a channel formed longitudinally inside a mast of the sailing vessel.

6. The method of claim 1, further comprising:

after the hull has been submerged under the water, waiting, by the processor, until a second predetermined event occurs before causing the hull to begin resurfacing;

determining, by the processor, that the second predetermined event has occurred; and causing, by the processor, the hull to begin resurfacing in response to determining that the second predetermined event has occurred.

7. The method of claim 6, wherein the predetermined event comprises present or imminent inclement weather and the second predefined event comprises a passing of the inclement weather, and determining that the inclement weather has passed comprises:

determining, by the processor via a motion detector coupled to the processor, that an acceleration of the sailing vessel no longer exceeds a predetermined threshold.

8. The method of claim 6, wherein the predetermined event comprises present or imminent inclement weather and the second predefined event comprises a passing of the inclement weather, and determining that the inclement weather has passed comprises:

deploying, by the processor, a buoy, the buoy communicatively coupled to the processor, the buoy configured to float to a surface of the water when deployed and generate a signal indicative of a magnitude of a wind speed or wave activity and send the signal to the processor; and determining, by the processor, that the inclement weather has passed when the signal indicates that the wind speed or the wave activity is less than a predetermined threshold.

9. The method of claim 1, wherein the predetermined event comprises the sailing vessel capsizing, and determining that the sailing vessel has capsized comprises:

determining, by the processor via an attitude sensor coupled to the processor, that an attitude of the mast has exceeded a second predetermined angle for more than a predetermined amount of time.

10. The method of claim 1, further comprising:

determining, by the processor via a depth sensor, that the sailing vessel has descended to a predetermined depth; and in response to determining that the sailing vessel has descended to the predetermined depth, causing, by the processor, the hull to stop descending deeper into the water and to maintain the predetermined depth.

11. A self-righting sailing vessel, comprising:

a hull;

a rig coupled to the hull, the rig comprising a mast and a sail;

an outrigger coupled to the hull;

an attitude sensor; and a processing unit comprising a processor coupled to a memory, the memory comprising processor-executable instructions that, when executed by the processor, causes the processing unit to:

determine, by the processor, an occurrence of a predetermined event;

in response to determining the occurrence, causing, by the processor, the hull to completely submerge beneath water;

determine, by the processor via the attitude sensor, that an attitude of the mast is less than a predetermined angle; and in response to determining that the attitude of the mast is less than the predetermined angle, cause, by the processor, the hull to begin resurfacing.

12. The self-righting sailing vessel of claim 11, wherein the processor-executable instructions further comprise additional processor-executable instructions that causes the processing unit to:

determine, by the processor, that the hull is at least partially exposed to air while the hull is resurfacing; and in response to determining that the hull is at least partially exposed to the air, cause, by the processor, the hull to stop resurfacing.

13. The self-righting sailing vessel of claim 11, wherein the processor-executable instructions further comprise additional processor-executable instructions that causes the processing unit to:

while resurfacing, determine, by the processor, that the attitude of the mast is not within the predetermined angle; and cause, by the processor, the sailing vessel to stop resurfacing when the attitude of the mast is not within the predetermined angle.

14. The self-righting sailing vessel of claim 11, further comprising:

a compressed gas tank;

wherein the processor-executable instructions that causes the sailing vessel to begin resurfacing comprises processor-executable instructions that causes the processing unit to:

cause, by the processor, compressed air from the compressed gas tank to enter the outrigger, a ballast tank of the sailing vessel and/or the hull.

15. The self-righting sailing vessel of claim 11, further comprising:

a pump;

wherein the mast comprises a channel formed longitudinally inside of the mast;

wherein the processor-executable instructions that causes the sailing vessel to begin resurfacing comprises processor-executable instructions that causes the processing unit to:

pumping, by the processor via the pump, ambient air into the outrigger, a ballast tank of the sailing vessel, and/or the hull, the ambient air received by the pump via the channel inside the mast.

16. The self-righting sailing vessel of claim 11, wherein the processor-executable instructions further comprise additional processor-executable instructions that causes the processing unit to:

after the hull has been completely submerged under the water, wait, by the processor, until a second predetermined event occurs before causing the hull to begin resurfacing;

determine, by the processor, that the second predetermined event has occurred; and cause, by the processor, the hull to begin resurfacing in response to determining that the second predetermined event has occurred.

17. The self-righting sailing vessel of claim 16, further comprising:

a motion detector coupled to the processor;

wherein the predetermined event comprises present or imminent inclement weather and the second predefined event comprises a passing of the inclement weather, and the processor-executable instructions that causes the processing unit to determine that the inclement weather has passed comprises processor-executable instructions that causes the processing unit to:

determine, by the processor via the motion detector, that an acceleration of the sailing vessel no longer exceeds a predetermined threshold.

18. The self-righting sailing vessel of claim 16, further comprising:

a buoy communicatively coupled to the processing unit;

wherein the predetermined event comprises present or imminent inclement weather and the second predefined event comprises a passing of the inclement weather, and determining that the inclement weather has passed comprises:

deploy, by the processor, the buoy, the buoy configured to float to a surface of the water when deployed and generate a signal indicative of a magnitude of a wind speed or wave activity and send the signal to the processor; and determine, by the processor, that the inclement weather has passed when the signal indicates that the wind speed or the wave activity is less than a predetermined threshold.

19. The self-righting sailing vessel of claim 11, wherein the predetermined event comprises the sailing vessel capsizing, and the processor-executable instructions that causes the processing unit to determine that the sailing vessel has capsized comprises processor-executable instructions that causes the processing unit to:

determine, by the processor via the attitude sensor, that an attitude of the mast has exceeded a second predetermined angle for more than a predetermined amount of time.

20. The self-righting sailing vessel of claim 11, a depth sensor coupled to the processor;

wherein the processor-executable instructions further comprise additional processor-executable instructions that causes the processing unit to:

determine, by the processor via a depth sensor, that the sailing vessel has descended to a predetermined depth; and in response to determining that the sailing vessel has descended to the predetermined depth, cause, by the processor, the hull to stop descending deeper into the water and to maintain the predetermined depth.

* * * * *